US006581527B2

(12) United States Patent
Hewitt

(10) Patent No.: US 6,581,527 B2
(45) Date of Patent: Jun. 24, 2003

(54) ADJUSTABLE SIDE BEARING FOR A RAILCAR

(75) Inventor: Paul Hewitt, Angus (GB)

(73) Assignee: Meridian Rail Information Systems Corp., Lombard, IL (US)

( * ) Notice: Subject to any disclaimer, the term of this patent is extended or adjusted under 35 U.S.C. 154(b) by 0 days.

(21) Appl. No.: 09/947,984

(22) Filed: Sep. 6, 2001

(65) Prior Publication Data

US 2002/0104459 A1 Aug. 8, 2002

Related U.S. Application Data

(60) Provisional application No. 60/231,558, filed on Sep. 11, 2000.

(51) Int. Cl.[7] ..... B61F 3/00

(52) U.S. Cl. ..... 105/199.3; 105/199.2; 267/3; 384/40

(58) Field of Search ..... 105/199.3, 199.1, 105/199.2, 199.4; 384/40; 324/423; 267/3, 4

(56) References Cited

U.S. PATENT DOCUMENTS

| | | | | |
|---|---|---|---|---|
| 2,254,791 A | * | 9/1941 | Blattner | 267/3 |
| 2,327,954 A | * | 8/1943 | Barrows et al. | 105/199.3 |
| 2,543,484 A | * | 2/1951 | Borup | 267/3 |
| 2,617,697 A | * | 11/1952 | Blattner | 267/210 |
| 2,636,789 A | | 4/1953 | Blattner | |
| 3,514,169 A | * | 5/1970 | MacDonnell | 384/368 |
| 3,600,047 A | * | 8/1971 | MacDonnell | 384/39 |
| 4,245,564 A | | 1/1981 | Eulenfeld | |
| 4,638,742 A | | 1/1987 | Potel et al. | |
| 4,706,826 A | | 11/1987 | Elliott et al. | |
| 4,784,068 A | | 11/1988 | Burke | |
| 4,913,062 A | | 4/1990 | Burke | |
| 5,086,707 A | | 2/1992 | Spencer et al. | |

FOREIGN PATENT DOCUMENTS

| | | |
|---|---|---|
| FR | 1416115 | 9/1965 |
| GB | 2032369 | 5/1980 |

* cited by examiner

*Primary Examiner*—S. Joseph Morano
*Assistant Examiner*—Frantz F. Jules
(74) *Attorney, Agent, or Firm*—Barnes & Thornburg

(57) ABSTRACT

A side bearing for a railcar having a car body and a bolster. The side bearing includes a top member adapted to be located adjacent the car body of the railcar. The top member includes a downwardly extending projection. The side bearing also includes a base member adapted to be located adjacent the bolster of the railcar. The base member includes an upwardly extending support member, a wear plate holder coupled to the support member, and a wear plate coupled to the wear plate holder. First and second adjustment members are attached to the support member to selectively move the wear plate holder and the wear plate along a horizontal axis to adjust and maintain a zero or minimal clearance between the wear plate of the base member and the projection of the top member and thereby control movement of the railcar truck/car body interface.

10 Claims, 1 Drawing Sheet

ADJUSTABLE SIDE BEARING FOR A RAILCAR

RELATED APPLICATIONS

This application claims the benefit of the U.S. Provisional Application No. 60/231,558, filed Sep. 11, 2000.

BACKGROUND OF THE INVENTION

The present invention is directed to a side bearing for a railcar, and in particular to a side bearing having a base member including a wear plate that can be horizontally adjusted.

A railcar includes a car body that is supported on a pair of trucks. Each truck includes a pair of generally parallel side frames and a transverse bolster extending between the side frames. The car body is attached to a center plate on the truck bolster. Side bearings are attached to the bolster on each side of the center plate to stabilize vertical rocking movement of the car body about the center plate.

SUMMARY OF THE INVENTION

A side bearing for a railcar having a car body and a bolster. The side bearing includes a top member adapted to be located adjacent the car body of the railcar. The top member includes a downwardly extending projection having a pair of wear plates located on opposite sides of the projection. The side bearing also includes a base member adapted to be located adjacent the bolster of the railcar. The base member includes a longitudinal axis and an upwardly extending first support member. The first support member includes a rear wall, a first side wall and a second side wall that form a pocket. A wear plate holder is located within the pocket of the first support member and a wear plate is coupled to the wear plate holder. The rear wall of the first support member includes a bore. A plunger extends through the bore and couples the wear plate holder to the first support member. The plunger is slidable within the bore such that the wear plate holder and the first wear plate are selectively movable with respect to the first support member along the longitudinal axis of the base member. The wear plate holder includes a beveled first rear edge and a beveled second rear edge. A first adjustment member such as a threaded fastener is attached to the first side wall of the first side member and is adapted to engage the first rear edge of the wear plate holder. A second adjustment member such as a threaded fastener is attached to the second side wall of the first support member and is adapted to engage the second rear edge of the wear plate holder. The bottom member also includes a second support member and a wear plate coupled to the second support member. The projection of the top member is located between the wear plates of the bottom member. Selective rotation of the first and second adjustment members moves the wear plate holder and its wear plate along the longitudinal axis with respect to the first support member and with respect to the projection of the top member to maintain a zero or minimal clearance between the wear plates of the base member and the projection of the top member.

BRIEF DESCRIPTION OF THE DRAWING FIGURES

DETAILED DESCRIPTION OF THE PREFERRED EMBODIMENT

Figure 1:
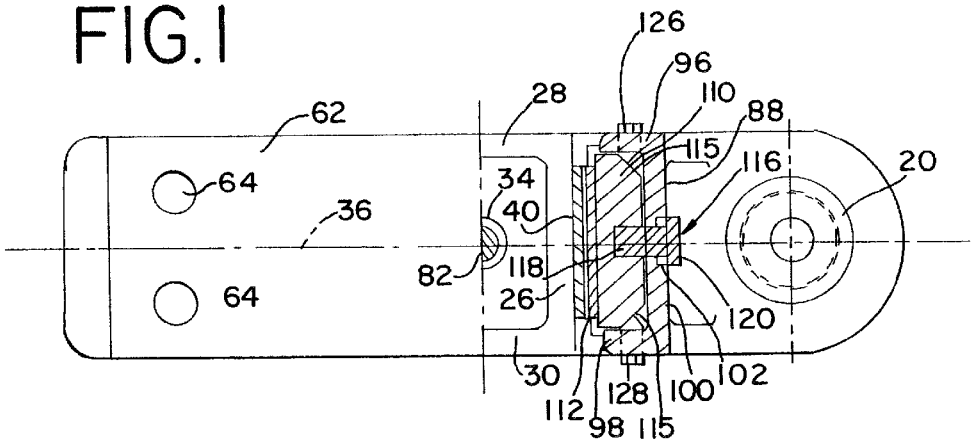
FIG. 1 is a bottom view of the adjustable side bearing shown partially in cross-section.

The side bearing 10 of the present invention includes a top member 12 having a upper surface 14 adapted to receive a friction pad 16. The first end of the top member 12 includes a downwardly extending generally cylindrical projection 18. The second end of the top member 12 includes a downwardly extending generally cylindrical projection 20. The top member 12 also includes a downwardly extending housing 22 that is located generally midway between the projections 18 and 20. The housing 22 includes a first side wall 24 and an opposing second side wall 26, a front wall 28 and an opposing rear wall 30, which are arranged in a generally rectangular manner. The housing 22 also includes a bottom wall 32 that extends between the walls 24, 26, 28, and 30. The bottom wall 32 includes a central aperture 34. The first and second sidewalls 24 and 26 are positioned generally perpendicular to a longitudinal axis 36 of the side bearing 10. A first wear plate 38 is attached to the outer surface of the first side wall 24 and a second wear plate 40 is attached to the outer surface of the second side wall 26. Each wear plate 38 and 40 includes an arc-shaped outer surface 42 that is curved about a horizontal axis. The wear plates 38 and 40 are positioned on opposite sides of the housing 22 along the longitudinal axis 36. The top member 12 and friction pad 16 are adapted to engage the car body of a railcar.

The side bearing 10 also includes a base member 60. The base member 60 includes a bottom surface 62 that is adapted to engage the bolster of a railcar truck. The base member 60 includes first downwardly extending studs 64 and second downwardly extending studs 66 respectively located at each end of the base member 60. The base member 60 also includes a first upwardly extending generally cylindrical projection 68 and a second upwardly extending generally cylindrical projection 70. The first projection 68 is located generally coaxially with the projection 18 of the top member 12. The second projection 70 is located generally coaxially with the projection 20 of the top member 12. A resilient coil spring 74 extends between the base member 60 and the top member 12. The projection 18 of the top member 12 extends downwardly into the center of the top end of the coil spring 74 and the first projection 68 of the base member 60 extends upwardly into the center of the bottom end of the coil spring 74. A resilient coil spring 76 extends between the base member 60 and the top member 12 such that the projection 20 extends downwardly into the center of the top end of the coil spring 76 and the second projection 70 extends upwardly into the center of the bottom end of the coil spring 76. A bumper member 78 is positioned at the upper end of the first projection 68 of the base member 60 and a bumper member 80 is positioned at the upper end of the second projection 70 of the base member 60. A gap is provided between each bumper member 78 and 80 and the respective projections 18 and 20 of the top member 12 to allow limited relative vertical movement of the top member 12 with respect to the base member 60. A pin 82 extends upwardly from the base member 60 and extends through the aperture 34 in the bottom wall 32 of the housing 22.

The base member 60 includes an upwardly extending first support member 84 which is located adjacent the first projection 68. The first support member 84 includes a generally planar wear plate 86 which faces the center of the base member 60 and which is located generally perpendicular to the longitudinal axis 36 of the side bearing 10. The wear plate 86 is adapted to engage the first wear plate 38 of the top member 12. The base member 60 also includes a second upwardly extending support member 88. The second support member 88 includes a pocket 90 which is open toward the center of the base member 60. The pocket 90 includes a bottom wall 92 and a spaced apart top wall 94. The pocket 90 also includes a first side wall 96 and a spaced apart and generally parallel second side wall 98. The pocket 90 also includes a generally planar rear wall 100. The rear wall 100 includes a horizontally disposed stepped bore 102 having a first small diameter portion adjacent the interior surface of the rear wall 100 and a second large diameter portion located adjacent the outer surface of the rear wall 100.

Figure 2:
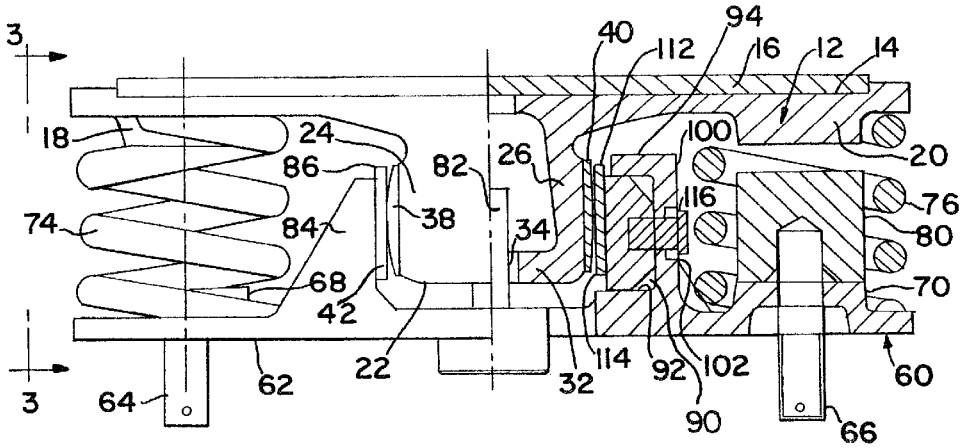
FIG. 2 is a front elevational view of the side bearing shown partially in cross-section.
Figure 3:
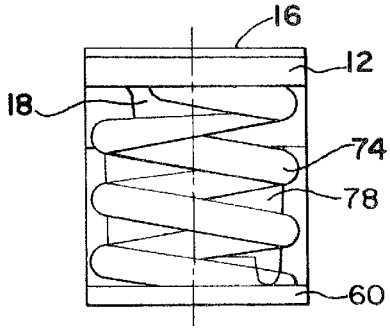
FIG. 3 is an end view of the side bearing taken along line 3–3 of FIG. 2.

The support member 88 includes a wear plate holder 110 disposed within the pocket 90 of the support member 88. The wear plate holder 110 is generally rectangular and includes a planar front surface to which a wear plate 112 is attached. The wear plate 112 is generally rectangular and includes a generally planar outer surface 114 that is adapted to engage the outer surface of the second wear plate 40 of the top member 12. The wear plate holder 110 and the wear plate 112 are adapted to be movable longitudinally in either direction along the longitudinal axis 36 of the side bearing 10. The rear edges 115 of the wear plate holder 110 are beveled. A plunger 116 includes a threaded shaft 118 that extends through the small diameter portion of the bore 102 in the second support member 88 and that is threadably attached to the wear plate holder 110. The plunger 116 includes a head 120 which is adapted to fit within the large diameter portion of the bore 102. The wear plate holder 110 and wear plate 112 are located in a first position, as shown in FIGS. 1 and 2, wherein the rear surface of the wear plate holder 110 engages the rear wall 100 of the second support member 88 and there is a gap between the head of the plunger 116 and the rear wall 100. The wear plate holder 110 and wear plate 112 are movable longitudinally along the longitudinal axis 36 toward the wear plate 40 of the top member 12 to a second position where the wear plate 112 engages the wear plate 40, or the head of the plunger 116 engages the rear wall 100 of the second support member 88. The plunger 116 preferably provides the wear plate holder 110 and wear plate 112 with approximately five millimeters of horizontal longitudinal movement.

A first threaded adjustment screw 126 is threadably attached to and extends through the first side wall 96 of the second support member 88 such that the tip of the adjustment screw 126 extends into the pocket 90. A second threaded adjustment screw 128 is threadably attached to and extends through the second side wall 98 of the second support member 88 such that the tip of the adjustment screw 128 is located within the pocket 90. The tip of each adjustment screw 126 and 128 is generally conical-shaped and is adapted to engage a respective beveled corner 115 of the wear plate holder 110 on opposite sides of the plunger 116. As the adjustment screws 126 and 128 are rotated so that the tips of the screws move further into the pocket 90, the tips of the screws 126 and 128 force the wear plate holder 110 and wear plate 112 to move along the longitudinal axis 36 toward the wear plate 40 of the top member 12. Adjustment and maintenance of zero or minimal clearance between the wear plates 86 and 112 of the base member 60 and the wear plates 38 and 40 of the top member 12 is controlled by appropriate rotation of the adjustment screws 126 and 128 which in turn locate the position of the wear plate holder 110 and wear plate 112. To control secondary hunting, longitudinal movement of the railcar truck/car body interface is restricted by reducing the gap between the wear plates of the top member 12 and the wear plates of the base member 60 to zero.

Various features of the invention have been particularly shown and described in connection with the illustrated embodiments of the invention, however, it must be understood that these particular arrangements merely illustrate, and that the invention is to be given its fullest interpretation within the terms of the appended claims.

What is claimed is:

1. A side bearing for a railcar having a car body and a bolster, said side bearing including:

a top member adapted to be located adjacent the car body of the railcar, said top member including a downwardly extending projection;

a base member adapted to be located adjacent the bolster of the railcar, said base member including a longitudinal axis, an upwardly extending first support member, a wear plate holder coupled to said first support member, said first support member including a pocket adapted to receive said wear plate holder, a first wear plate coupled to said wear plate holder, said first wear plate adapted to engage said projection of said top member, said wear plate holder and said first wear plate adapted to be selectively movable with respect to said first support member along said longitudinal axis, and a first adjustment member adapted to selectively move said first wear plate and said wear plate holder along said longitudinal axis with respect to said first support member and with respect to said projection of said top member;

whereby said first adjustment member selectively positions said first wear plate along said longitudinal axis with respect to said projection of said top member.

2. The side bearing of claim 1 wherein said first support member includes a rear wall having a bore, and a plunger extending through said bore, said plunger being attached to said wear plate holder and being slidable within said bore with respect to said first support member.

3. The side bearing of claim 1 wherein said first adjustment member comprises a fastener threadably attached to said first support member, said fastener adapted to engage said wear plate holder and to selectively move said wear plate holder along said longitudinal axis with respect to said first support member.

4. The side bearing of claim 1 wherein said first support member includes a first side wall and a second side wall, said wear plate holder being located between said first and second side walls, said first adjustment member being attached to said first side wall and adapted to engage said wear plate holder, said base member including a second adjustment member attached to said second side wall of said first support member adapted to engage said wear plate holder.

5. The side bearing of claim 4 wherein said first adjustment member comprises a first threaded fastener and said second adjustment member comprises a second threaded fastener.

6. The side bearing of claim 4 wherein said wear plate holder includes a beveled first rear edge and a beveled second rear edge, said first adjustment member adapted to engage said first rear edge of said wear plate holder and said second adjustment member adapted to engage said second rear edge of said wear plate holder.

7. The side bearing of claim 1 wherein said base member includes a second support member and a second wear plate coupled to said second support member, said projection of said top member being located between said first wear plate and said second wear plate of said base member.

8. The side bearing of claim 7 wherein said projection of said top member includes a third wear plate adapted to engage said first wear plate of said base member and a fourth wear plate adapted to engage said second wear plate of said base member.

9. A side bearing for a railcar having a car body and a bolster, said side bearing including:

a top member adapted to be located adjacent the car body of the railcar, said top member including a downwardly extending projection;

a base member adapted to be located adjacent the bolster of the railcar, said base member including a longitudinal axis, an upwardly extending support member, a wear plate holder coupled to said support member, a wear plate coupled to said wear plate holder, said wear plate holder and said wear plate being conjointly movable along said longitudinal axis, said wear plate adapted to engage said projection of said top member, and a first adjustment member adapted to selectively move said wear plate along said longitudinal axis with respect to said support member and with respect to said projection of said top member, said support member including a first side wall and a second side wall, said wear plate holder being located between said first and second side walls, said first adjustment member being attached to said first side wall and adapted to engage said wear plate holder, said base member including a second adjustment member attached to said second side wall of said support member and adapted to engage said wear plate holder;

whereby said first and second adjustment members selectively position said wear plate along said longitudinal axis with respect to said projection of said top member.

10. A side bearing for a railcar having a car body and a bolster, said side bearing including:

a top member adapted to be located adjacent the car body of the railcar, said top member including a downwardly extending projection;

a base member adapted to be located adjacent the bolster of the railcar, said base member including a longitudinal axis, an upwardly extending first support member, a first wear plate coupled to said first support member, said first wear plate adapted to engage said projection of said top member and to be selectively movable with respect to said first support member along said longitudinal axis, and an adjustment member adapted to selectively move said first wear plate along said longitudinal axis with respect to said first support member and with respect to said projection of said top member, said base member including a second support member and a second wear plate coupled to said second support member, said projection of said top member being located between said first wear plate and said second wear plate of said base member, and said projection of said top member includes a third wear plate adapted to engage said first wear plate of said base member and a fourth wear plate adapted to engage said second wear plate of said base member;

whereby said adjustment member selectively positions said first wear plate along said longitudinal axis with respect to said projection of said top member.

* * * * *